US011558683B2

(12) United States Patent
Yetukuri et al.

(10) Patent No.: US 11,558,683 B2
(45) Date of Patent: Jan. 17, 2023

(54) SOUND SYSTEM

(71) Applicant: Lear Corporation, Southfield, MI (US)

(72) Inventors: Arjun Yetukuri, Rochester Hills, MI (US); David A. Hein, Sterling Heights, MI (US); Kim Krulek, Wyoming, MI (US); Peter Festag, Erding (DE); Stefan Willems, Leuven (BE); Mladen Humer, West Bloomfield, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/109,769

(22) Filed: Dec. 2, 2020

(65) Prior Publication Data

US 2021/0176545 A1 Jun. 10, 2021

(30) Foreign Application Priority Data

Dec. 4, 2019 (DE) ..... 102019218889.3

(51) Int. Cl.
*H04R 1/02* (2006.01)
*H04R 1/26* (2006.01)
*H04R 1/22* (2006.01)

(52) U.S. Cl.
CPC ..... *H04R 1/025* (2013.01); *H04R 1/26* (2013.01); *H04R 1/227* (2013.01)

(58) Field of Classification Search
CPC ..... H04R 1/26; H04R 5/02; H04R 2499/13; H04R 1/227; H04R 1/025; H04R 5/023; H04R 1/20; H04R 1/32; H04R 1/323; H04R 1/403; H04R 1/40; H04S 2400/07; B60R 11/0217
See application file for complete search history.

(56) References Cited

U.S. PATENT DOCUMENTS 3,512,605 A 5/1970 McCorkle
4,025,724 A 5/1977 Davidson, Jr. et al.
(Continued)

FOREIGN PATENT DOCUMENTS

CN 107351741 A 11/2017
EP 0993230 A2 4/2000
(Continued)

OTHER PUBLICATIONS

"10 Million Translations Later, SayHi Translate Rolls Out Major Update" May 24, 2012; https://techcrunch.com/2012/05/24/10-million-translations-later-sayhi-translate-rolls-out-major-update/.

*Primary Examiner* — Kile O Blair
(74) *Attorney, Agent, or Firm* — Fishman Stewart PLLC

(57) ABSTRACT

A sound system includes a seat including a seatback having a first dipole subwoofer, a second dipole subwoofer, a first speaker, and a second speaker; and a seat bottom having a third speaker. The first dipole subwoofer, the second dipole subwoofer, the first speaker, the second speaker, and/or the third speaker may be configured to receive audio signals from a receiver and provide sound corresponding to the audio signals toward an occupant position of the seat. The third speaker may be directed toward the seat back. The first dipole subwoofer, the second dipole subwoofer, the first speaker, the second speaker, and/or the third speaker may be configured to provide a sound zone for said occupant that facilitates (i) hearing of the sound by said occupant, and/or (ii) limiting transmission of the sound beyond the seat.

19 Claims, 14 Drawing Sheets

(56) References Cited

U.S. PATENT DOCUMENTS

| | | | |
|---|---|---|---|
| 4,027,112 | A | 5/1977 | Heppner et al. |
| 4,490,842 | A | 12/1984 | Watanabe |
| 5,314,403 | A | 5/1994 | Shaw |
| 5,887,071 | A | 3/1999 | House |
| 7,457,425 | B2 | 11/2008 | Fincham |
| 7,918,308 | B2 | 4/2011 | Cohen |
| 3,154,418 | A1 | 4/2012 | Peterson |
| 2009/0067657 | A1 | 3/2009 | Yasushi et al. |
| 2009/0257616 | A1 | 10/2009 | Kaneda et al. |
| 2012/0182242 | A1 | 7/2012 | Lindahl |
| 2012/0236388 | A1 | 9/2012 | De Wind |
| 2017/0085987 | A1 | 3/2017 | Celestinos et al. |
| 2017/0334357 | A1 | 11/2017 | Lewis |
| 2018/0012589 | A1 | 1/2018 | MacNeille |
| 2019/0394604 | A1* | 12/2019 | Van Laack ..... H04R 5/04 |
| 2020/0018976 | A1* | 1/2020 | Van Wiemeersch ... B60K 35/00 |

FOREIGN PATENT DOCUMENTS

| | | | |
|---|---|---|---|
| EP | 1397021 | A1 | 3/2004 |
| JP | H07264689 | A | 10/1995 |
| WO | 2019/192808 | A1 | 10/2019 |

* cited by examiner

SOUND SYSTEM

CROSS-REFERENCE TO RELATED APPLICATION

This application claims priority to German Application No. 102019218889.3 filed Dec. 4, 2019, the contents of which are hereby incorporated by reference in its entirety as though fully set forth herein.

TECHNICAL FIELD

The present disclosure generally relates to sound systems, including sound systems that may, for example, be used in connection with vehicles, such as automobiles.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

Some sound systems may not allow for efficient communication, may involve excessive background noise, and/or may be complicated to use.

There is a desire for solutions/options that address, minimize, and/or eliminate one or more challenges or shortcomings of sound systems. The foregoing discussion is intended only to illustrate examples of the present field and is not a disavowal of scope.

SUMMARY

In embodiments, a sound system may include a seat including a seatback having a first dipole subwoofer, a second dipole subwoofer, a first speaker, and a second speaker; and a seat bottom having a third speaker. The first dipole subwoofer, the second dipole subwoofer, the first speaker, the second speaker, and/or the third speaker may be configured to receive audio signals from a receiver and provide sound corresponding to the audio signals toward an occupant or occupant position of the seat. The third speaker may be directed toward the seat back. The first dipole subwoofer, the second dipole subwoofer, the first speaker, the second speaker, and/or the third speaker may be configured to provide a sound zone for said occupant that facilitates (i) hearing of the sound by said occupant, and/or (ii) limiting transmission of the sound beyond the seat. The first speaker and the second speaker may be configured to provide noise-canceling sound. The seatback may include a headrest. At least two of the first dipole subwoofer, the second dipole subwoofer, the first speaker, and/or the second speaker may be connected to the headrest.

With embodiments, a seatback may include a headrest. The first dipole subwoofer and/or the first speaker may be disposed at a first side of the headrest. The second dipole subwoofer and/or the second speaker may be disposed at a second side of the headrest. The first speaker and/or the second speaker may have an end-fire array configuration. The first speaker and the second speaker have a single dipole configuration. The first speaker and/or the second speaker may be disposed at least partially in the headrest. The first dipole subwoofer and/or the second dipole subwoofer may be disposed at least partially in the headrest. A sound system may include a user input device configured to receive a touch input from a first occupant for activating a private intercom with a second occupant. A sound system may include an electronic controller configured to facilitate substantially simultaneous translation of audio in a first language from the first occupant to a second language for the second occupant and/or a third language for a third occupant.

In embodiments, a method of operating a sound system may include providing, from a receiver, a first audio signal to a plurality of seats; providing sound corresponding to the first audio signal to respective occupants of the plurality of seats; providing, from the receiver, a second audio signal to a first seat of the plurality of seats; and/or providing sound corresponding to the second audio signal to the occupant of the first seat such that the sound corresponding to the second audio signal is substantially inaudible to other occupants. Providing sound corresponding to the second audio signal may include providing sound via a first dipole subwoofer, a second dipole subwoofer, a first speaker, a second speaker, and/or a third speaker. The first seat may include a seatback and a seat bottom. The seatback may include the first dipole subwoofer, the second dipole subwoofer, the first speaker, and/or the second speaker. The seat bottom may include the third speaker. The first speaker and/or the second speaker may have a single dipole configuration or an end-fire array configuration.

With embodiments, providing sound corresponding to the first audio signal may include providing sound via a respective sound assembly associated with each seat of the plurality of seats. Each respective sound assembly may include a plurality of speakers and/or a plurality of subwoofers. Providing sound corresponding to the second audio signal may include providing sound corresponding to the second audio signal via the respective sound assembly associated with the first seat and/or not providing sound corresponding to the second audio signal via the respective sound assemblies associated with other seats of the plurality of seats. The plurality of seats may include seven or more seats. The method may include receiving, via a user input device, a touch input from the occupant of the first seat to activate a private intercom with a second occupant. The method may include translating sound in a first language from the occupant of the first seat to a second language for the second occupant.

The foregoing and other potential aspects, features, details, utilities, and/or advantages of examples/embodiments of the present disclosure will be apparent from reading the following description, and from reviewing the accompanying drawings.

DETAILED DESCRIPTION

Reference will now be made in detail to embodiments of the present disclosure, examples of which are described herein and illustrated in the accompanying drawings. While the present disclosure will be described in conjunction with embodiments and/or examples, it will be understood that they do not limit the present disclosure to these embodiments and/or examples. On the contrary, the present disclosure covers alternatives, modifications, and equivalents.

Figure 1:
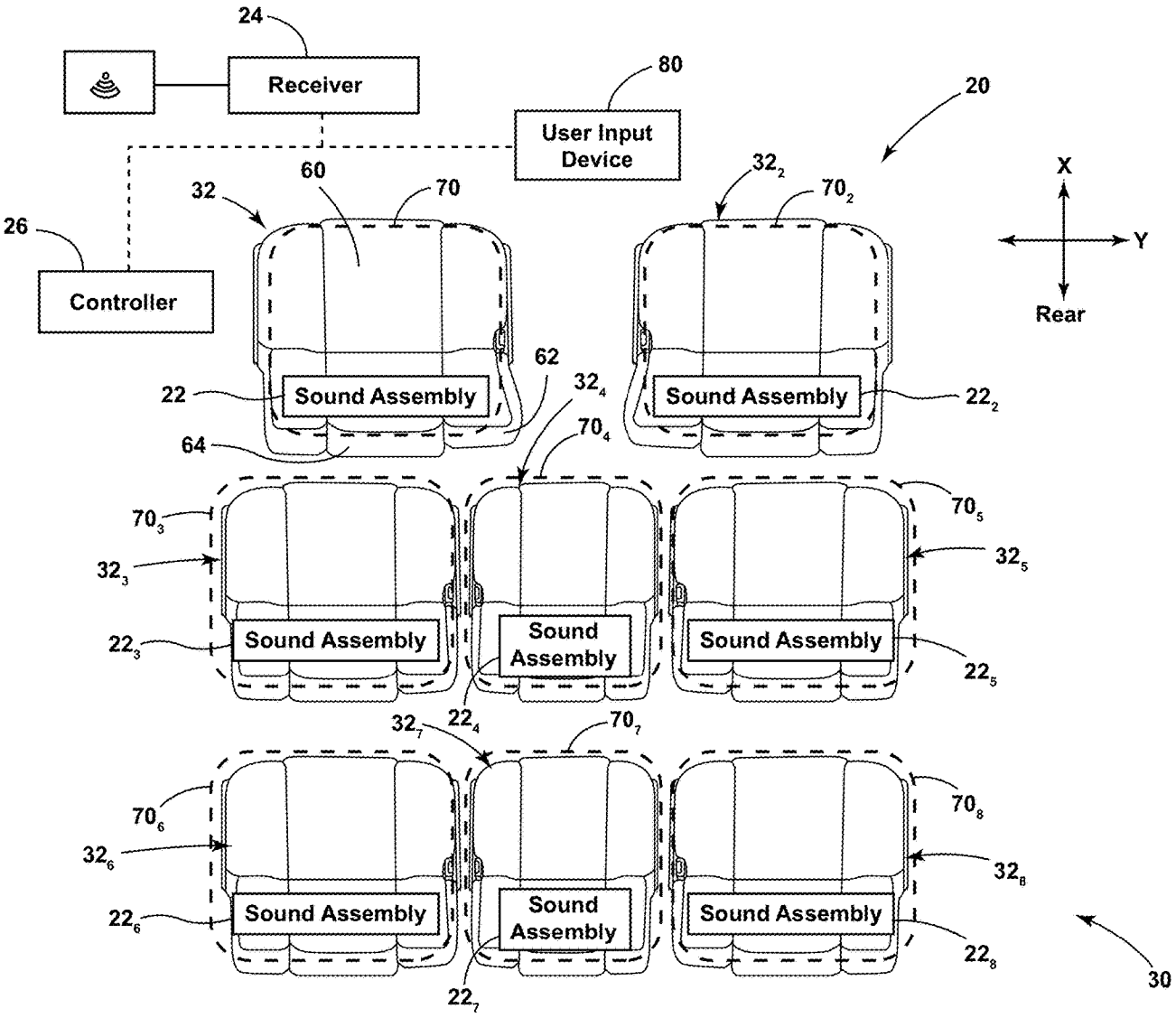
FIG. 1 is a top view generally illustrating an embodiment of a sound system according to teachings of the present disclosure.

In embodiments, such as generally illustrated in FIG. 1, a sound system 20 may include one or more sound assemblies 22, a receiver 24, and/or a controller 26. A sound system 20 may, for example and without limitation, be connected to and/or incorporated with a vehicle 30 that may include one or more seats 32 (e.g., seats 32, $\mathbf{32}_2$, $\mathbf{32}_3$, $\mathbf{32}_4$, $\mathbf{32}_5$, $\mathbf{32}_6$, $\mathbf{32}_7$, $\mathbf{32}_8$). In some configurations, each seat 32 may have a respective sound assembly (e.g., sounds assemblies 22, $\mathbf{22}_2$, $\mathbf{22}_3$, $\mathbf{22}_4$, $\mathbf{22}_5$, $\mathbf{22}_6$, $\mathbf{22}_7$, $\mathbf{22}_8$).

Figure 2A:
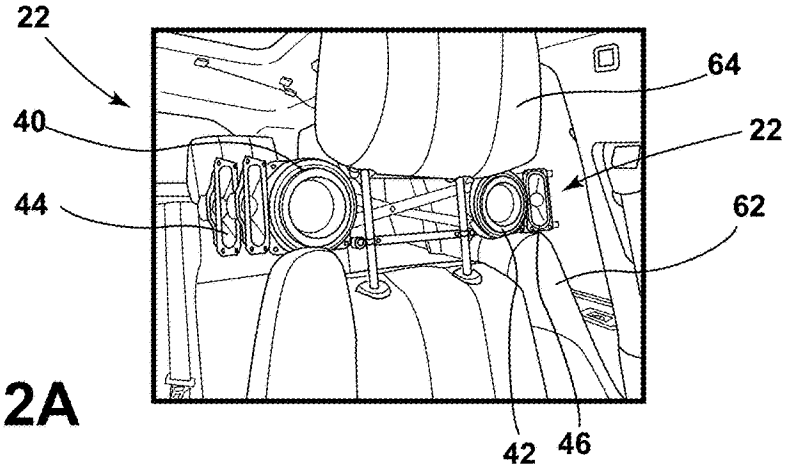
FIG. 2A is a perspective view generally illustrating an embodiment of a sound assembly of a sound system according to teachings of the present disclosure.
Figure 2C:
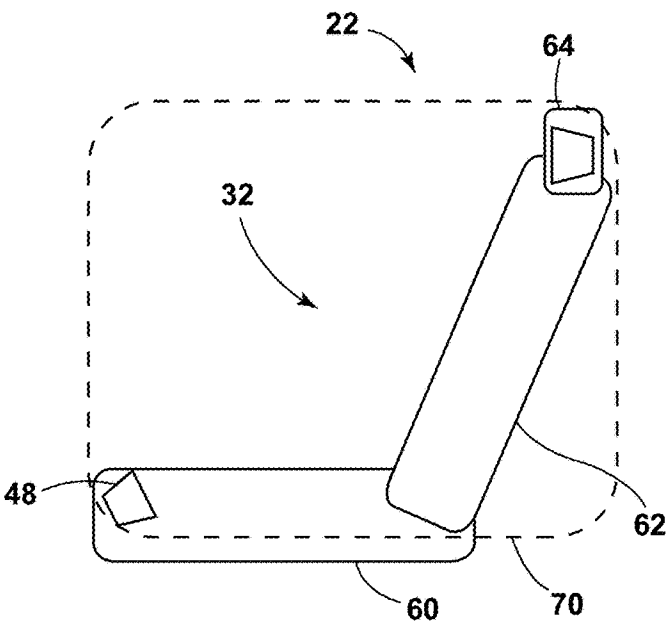
FIG. 2C is a side view generally illustrating an embodiment of a sound assembly of a sound system according to teachings of the present disclosure.
Figure 2B:
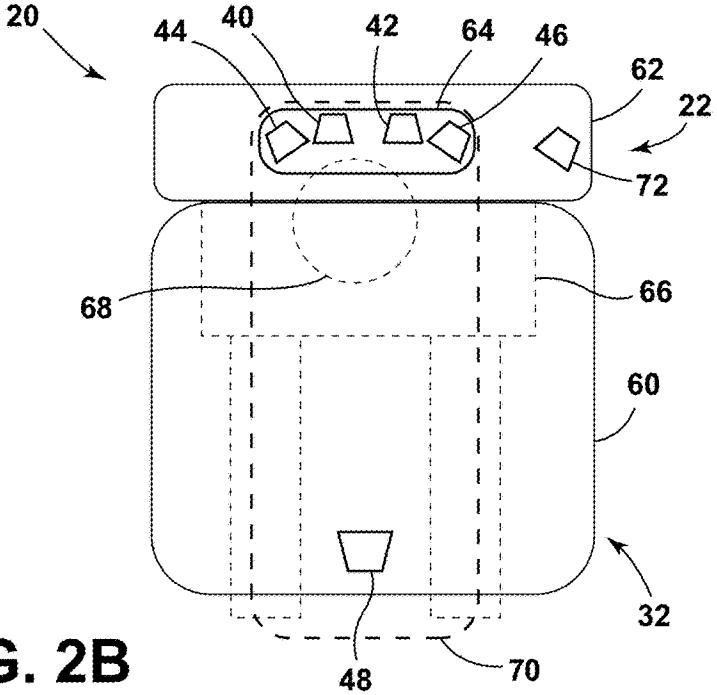
FIG. 2B is a top view generally illustrating an embodiment of a sound assembly of a sound system according to teachings of the present disclosure.

With embodiments, such as generally illustrated in FIGS. 2A, 2B, and 2C, a sound assembly 22 may include a first subwoofer 40, a second subwoofer 42, a first speaker 44, a second speaker 46, and/or a third speaker 48. The sound assembly 22 may be configured to receive signals (e.g., audio signals, radio frequency (RF) signals, and/or other signals), such as from the receiver 24, and provide sound via the first subwoofer 40, the second subwoofer 42, the first speaker 44, the second speaker 46, and/or the third speaker 48 corresponding to the received signals. The first subwoofer 40 and/or the second subwoofer 42, for example and without limitation, may be configured as a dipole subwoofer and/or may not include an enclosure, which may facilitate low frequency reproduction, such as less than about 50 Hz for subwoofer diameters of about four inches. The first speaker 44, the second speaker 46, and/or the third speaker 48 may, for example and without limitation, be configured as loudspeakers and/or may include an end-fire mid-high array configuration.

In embodiments, a seat 32 may include a seat bottom 60 and/or a seatback 62 that may have a headrest 64. One or more components of a sound assembly 22 may be connected to the seatback 62 and/or one or more components of a sound assembly 22 may be connected to the seat bottom 60. For example and without limitation, the first subwoofer 40, the second subwoofer 42, the first speaker 44, and/or the second speaker 46 may be connected to and/or disposed at least partially in the headrest 64. With embodiments, the first subwoofer 40 and/or the second subwoofer 42 may be directed substantially toward a front of the seat 32 (e.g., along an X-direction). Additionally or alternatively, the first speaker 44 and/or the second speaker 46 may be angled such that, when the seat 32 is facing forward and aligned with the X-direction, the first speaker 44 and/or the second speaker 46, may be angled (e.g., at an oblique angle) relative to the X-direction and/or the Y-direction. The angle of the first speaker 44 and/or the second speaker 46 may be configured to direct sound toward the head 68 of an occupant 66 of the seat 32 and/or an expected position of a head of an occupant (e.g., an occupant position of the seat 32). The first subwoofer 40 and/or the first speaker 44 may, with some configurations, be disposed at or about a first side (e.g., a right side) of the headrest 64. The second subwoofer 42 and/or the second speaker 46 may, with some configurations, be disposed at or about a second side (e.g., a left side) of the headrest 64.

In embodiments, such as generally illustrated in FIGS. 2B and 2C, the third speaker 48 may be connected to and/or disposed at least partially in the seat bottom 60. The third speaker 48 may, for example, be angled (e.g., at an oblique angle) toward the headrest 64 (e.g., toward a position or expected position of the head 68 of an occupant 66), which may include being angled with respect to the Z-direction and/or the X-direction.

With embodiments, a sound assembly 22 may be configured to provide sound from a plurality of directions. For example and without limitation, the first and second subwoofers 40, 42 may be configured to provide sound from a first direction, the first speaker 44 may be configured to provide sound from a second direction, the second speaker 46 may be configured to provide sound from a third direction, and/or the third speaker 48 may be configured to provide sound from a fourth direction, some or all of which may be directed toward the position or expected position of the head 68 of an occupant 66 (see, e.g., FIG. 2B). Such a configuration may, for example, provide/create a sound zone 70 proximate a seat 32 with a sound assembly 22 that may be configured to facilitate hearing of sound from the sound assembly 22 by the occupant 66 of the seat 32 while rendering the sound to a reduced degree and/or such that the sound is substantially inaudible to occupants 66 of other seats or sound zones (e.g., in sound zones $\mathbf{70}_2$-$\mathbf{70}_8$ associated with seats $\mathbf{32}_2$-$\mathbf{32}_8$). For example and without limitation, the receiver 24 may be configured to provide signals to the sound assembly 22 of a driver's seat 32 for phone sounds, alarm sounds, and/or navigation instructions (among others) and the sound assembly 22 of the driver's seat 32 may provide corresponding sound to the driver/occupant 66 that is substantially inaudible to occupants 66 of other seats (e.g., seats $\mathbf{32}_2$-$\mathbf{32}_8$). Additionally or alternatively, sound assemblies 22 may be configured to apply noise canceling to sound not intentionally provided to the sound assembly 22 (e.g., via a microphone 72 and/or receiving signals for other sound assemblies 22 and generating cancelling sound therefor).

With embodiments, a sound system 20 may be configured to facilitate communication between occupants 66 of certain seats 32 within a vehicle 30, such as without disturbing other occupants 66 of the vehicle 30 (e.g., may include "private intercom" functionality). Additionally or alternatively, sound assemblies 22 of a sound system 20 may be configured to selectively apply noise canceling for seat 32 to noise emanating from certain seats (e.g. seats $\mathbf{32}_2$-$\mathbf{32}_8$ and/or associated occupants) selected by the occupant 66 within a vehicle 30 (e.g. may include a "mute" functionality). As generally illustrated in FIGS. 3-12, a sound system 20 may be controlled, at least in part, via a user input device 80. A user input device 80 may, for example and without limitation, include and/or be connected to a rear-view mirror of a vehicle 30. A user input device 80 may include a housing 82, a mirrored surface 84, and/or a switch 86. The user input device 80 may, for example and without limitation, be configured to receive a touch input from a first occupant 66 for selectively muting a second occupant 66.

Figure 3:
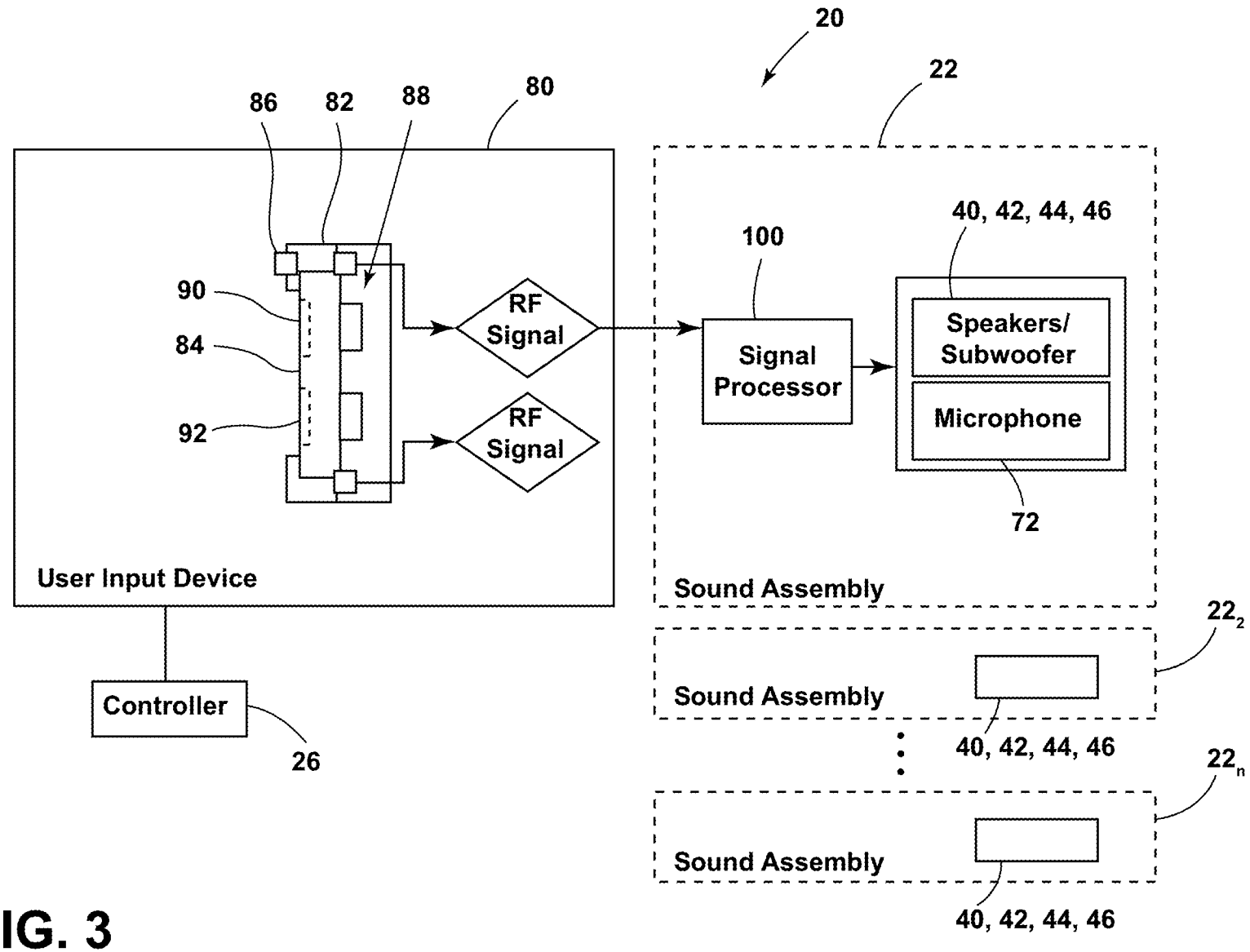
FIG. 3 is a schematic view generally illustrating an embodiment of a sound system according to teachings of the present disclosure.
Figure 4:
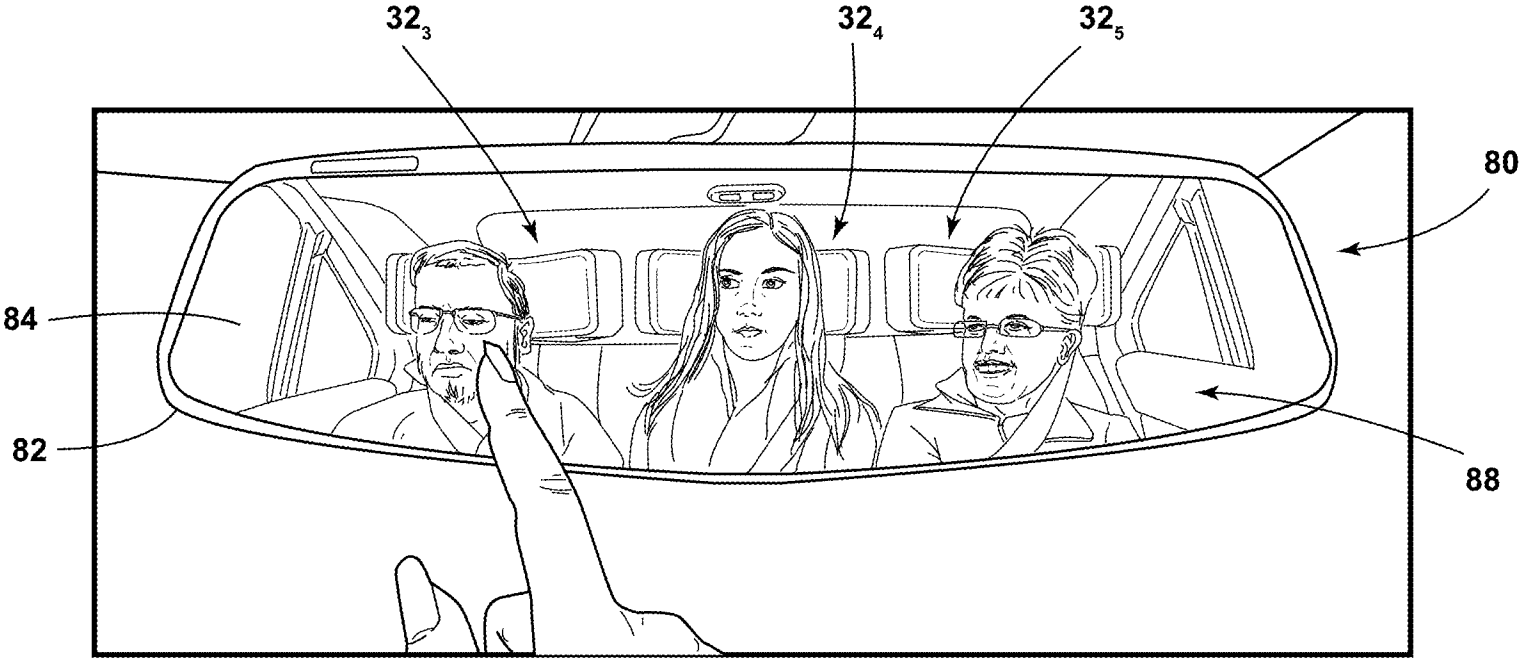
FIG. 4 is a perspective view generally illustrating an embodiment of a user input device of a sound system according to teachings of the present disclosure.
Figure 5:
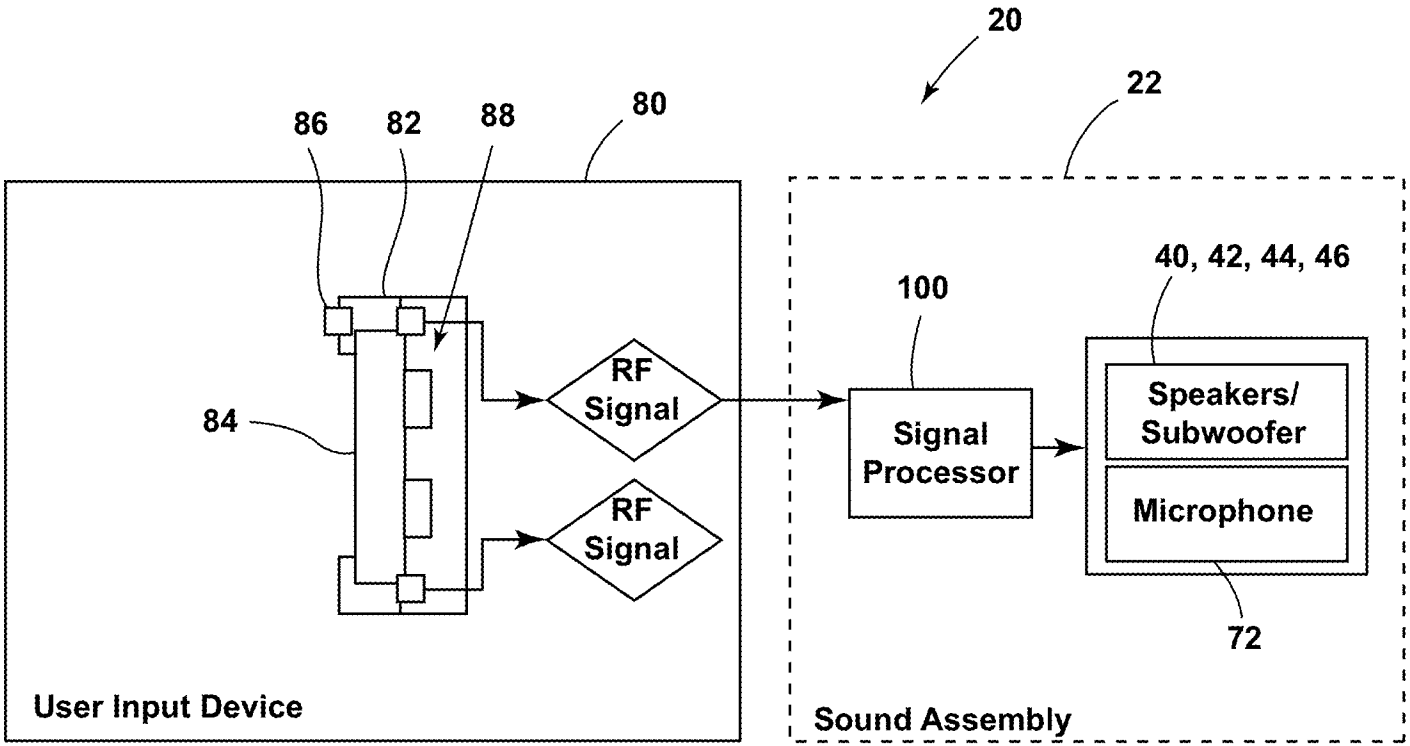
FIG. 5 is a schematic view generally illustrating an embodiment of a sound system according to teachings of the present disclosure.
Figure 6:
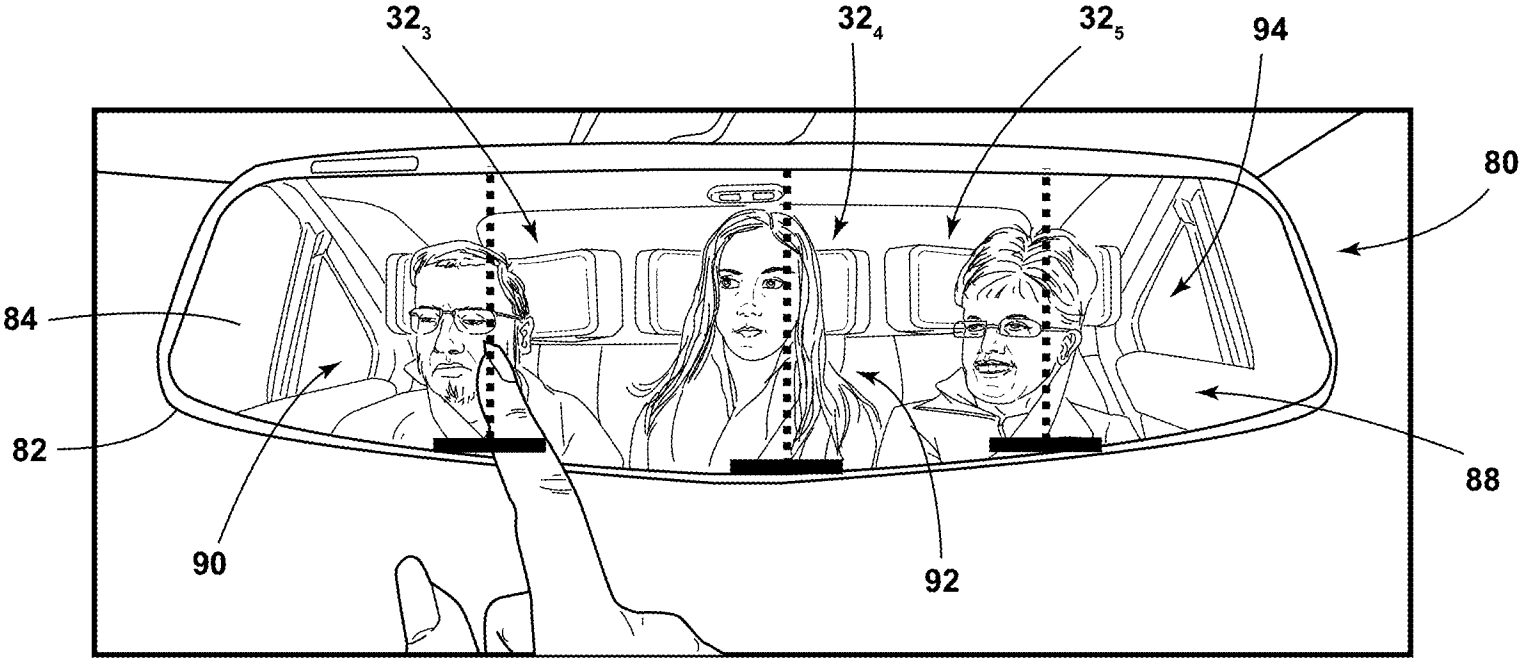
FIG. 6 is a perspective view generally illustrating an embodiment of a user input device of a sound system according to teachings of the present disclosure.

In embodiments, a user input device 80 may include one or more sensors that may be configured to sense input from a user/occupant 66. For example, a user input device 80 may include one or more sensors 88 that may be configured to sense if the hand of an occupant/user 66 is in proximity to and/or touching the user input device 80 (e.g., the mirrored surface 84). In embodiments, such as generally illustrated in FIGS. 3, 4, 5, and 6, the one or more sensors 88 may include one or more touch sensors (e.g., capacitive, resistive, acoustic, infrared, etc.) and may be referred to herein as touch sensors 88, but are not limited to touch sensors. An example of a touch sensor 88 configured as a capacitive sensor is generally illustrated in FIGS. 3 and 4. An example of a touch sensor 88 configured as an infrared sensor is generally illustrated in FIGS. 5 and 6.

With embodiments, such as generally illustrated in FIGS. 3-6, a switch 86 of a user input device 80 may be configured to turn a touch sensor 88 on and off. The switch 86 may, for example and without limitation, be disposed at or about a top of the user input device 80. If the switch 86 is switched off, the touch sensor 88 may not be active, and contact with the user input device 80 by an occupant 66 may not be sensed. If the switch 86 is switched on, the touch sensor 88 may be active and contact with the user input device 80 by an occupant 66 may be sensed. An occupant 66 may, for example, use the switch 86 to shut off the user input device 80 (or portions thereof) to avoid inadvertent activation of a sound system 20 and/or may use the switch 86 to power on the user input device 80 to utilize the sound system 20 (e.g., a private intercom function thereof).

As shown in FIGS. 3-6, a touch sensor 88 may be configured as a touch pad that may include a portion for each sound zone 70. For example and without limitation, a touch pad may include a first portion 90 corresponding to a first rear seat $\mathbf{32}_3$, a second portion 92 corresponding to a second rear seat $\mathbf{32}_4$, and/or a third portion 94 corresponding to a third rear seat $\mathbf{32}_5$. The portions 90, 92, 94 may be connected or separate. The touch sensor 88 may be configured to determine which portion 90, 92, 94 was touched by the occupant 66, and/or the user input device 80 (and/or a controller 26 connected thereto) may be configured to send a signal (e.g., an RF signal) to the corresponding seat $\mathbf{32}_3$, $\mathbf{32}_4$, $\mathbf{32}_5$ and/or a sound assembly $\mathbf{22}_3$, $\mathbf{22}_4$, $\mathbf{22}_5$ thereof. The signal may correspond to audio from the occupant 66 (e.g., speech) that may be received by a microphone 72.

With embodiments, such as generally illustrated in FIGS. 3 and 5, the sound assembly $\mathbf{22}_3$, $\mathbf{22}_4$, $\mathbf{22}_5$ of the corresponding seat $\mathbf{32}_3$, $\mathbf{32}_4$, $\mathbf{32}_5$ may include a signal processor 100 that may be configured to transform the signal received from the user input device 80 (e.g., an RF signal) and provide the transformed signal to the first subwoofer 40, the second subwoofer 42, the first speaker 44, the second speaker 46, and/or the third speaker 48 such that the audio from the occupant 66 is provided directly to the corresponding seat $\mathbf{32}_3$, $\mathbf{32}_4$, $\mathbf{32}_5$/sound assembly $\mathbf{22}_3$, $\mathbf{22}_4$, $\mathbf{22}_5$ and may not be provided to other seats/sound assemblies (e.g., except for noise canceling purposes or if multiple portions 90, 92, 94 are selected).

Figure 7:
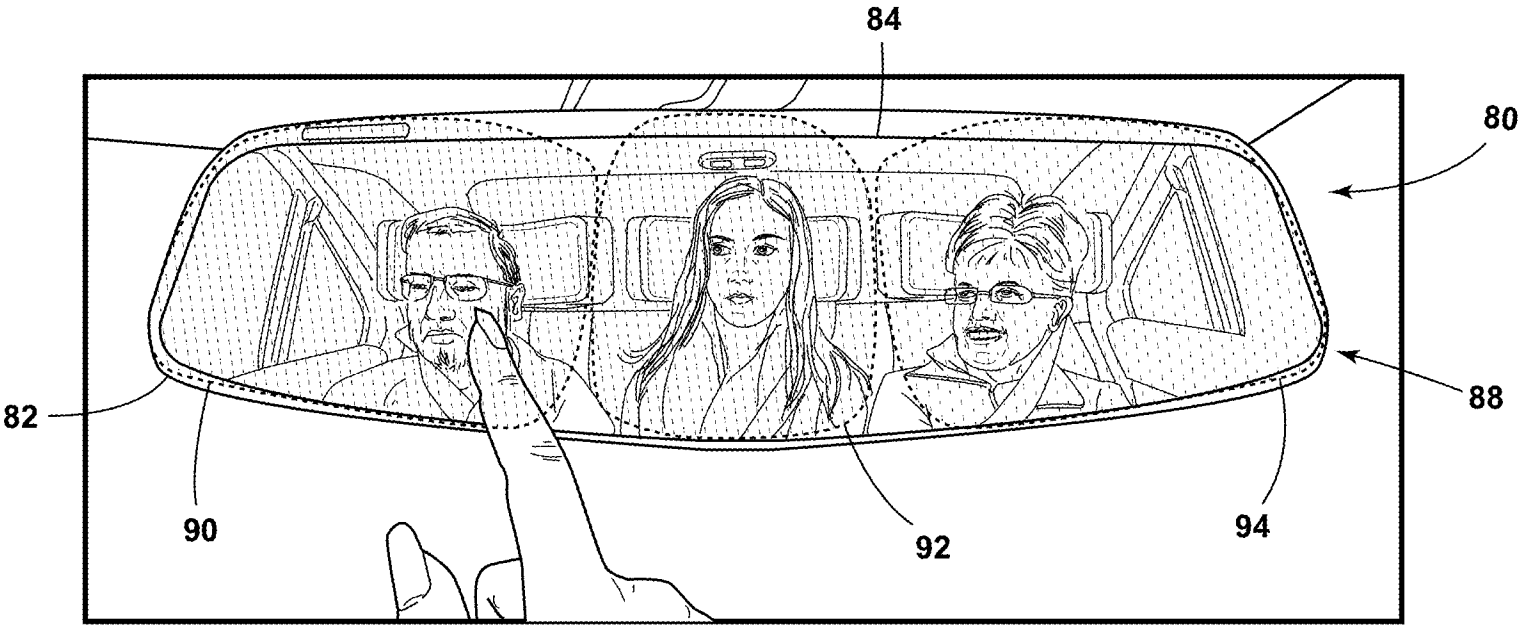
FIG. 7 is a perspective view generally illustrating an embodiment of a user input device of a sound system according to teachings of the present disclosure.
Figure 8:
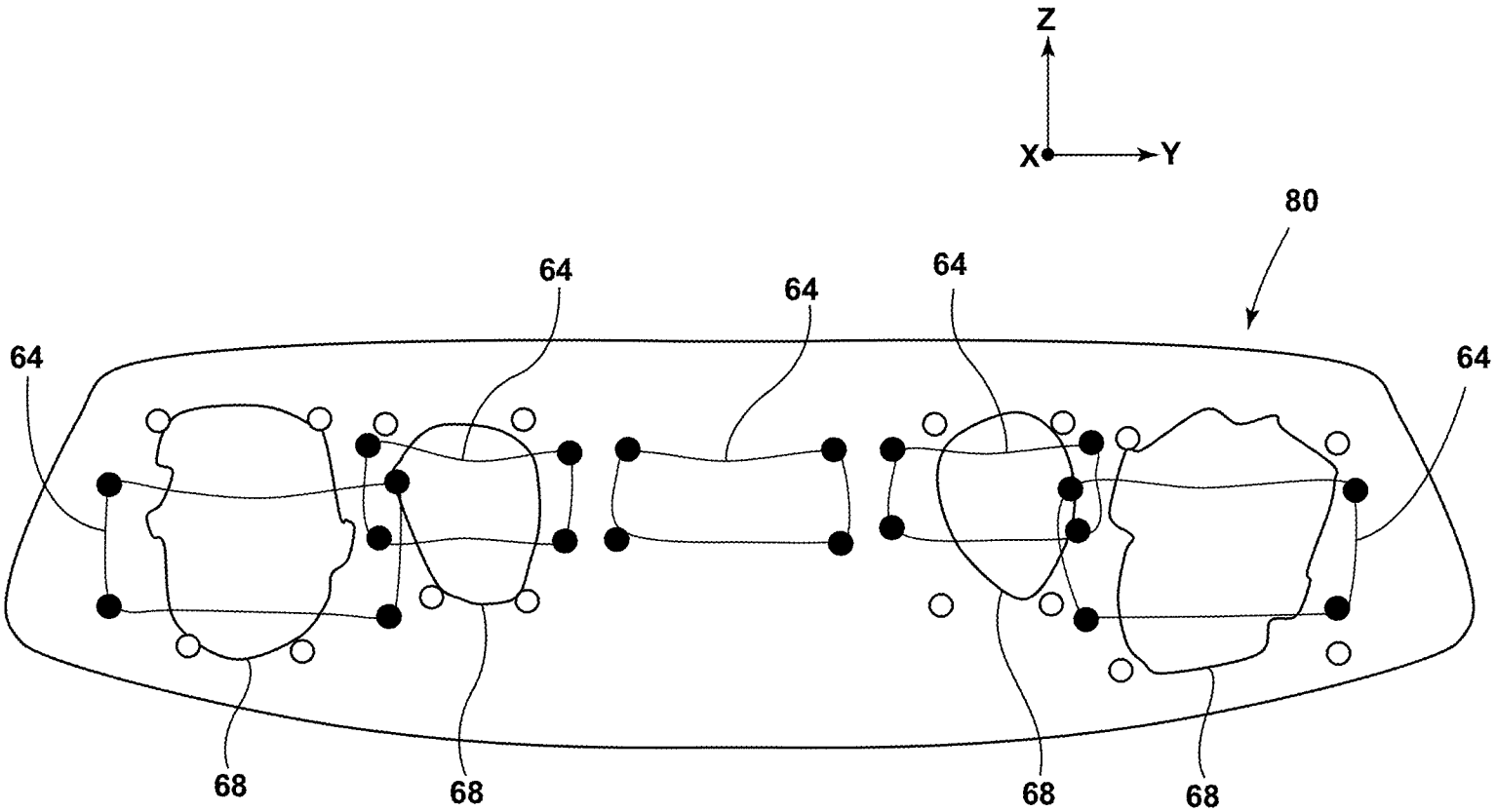
FIG. 8 is a front view generally illustrating an embodiment of a user input device of a sound system according to teachings of the present disclosure.
Figure 9:
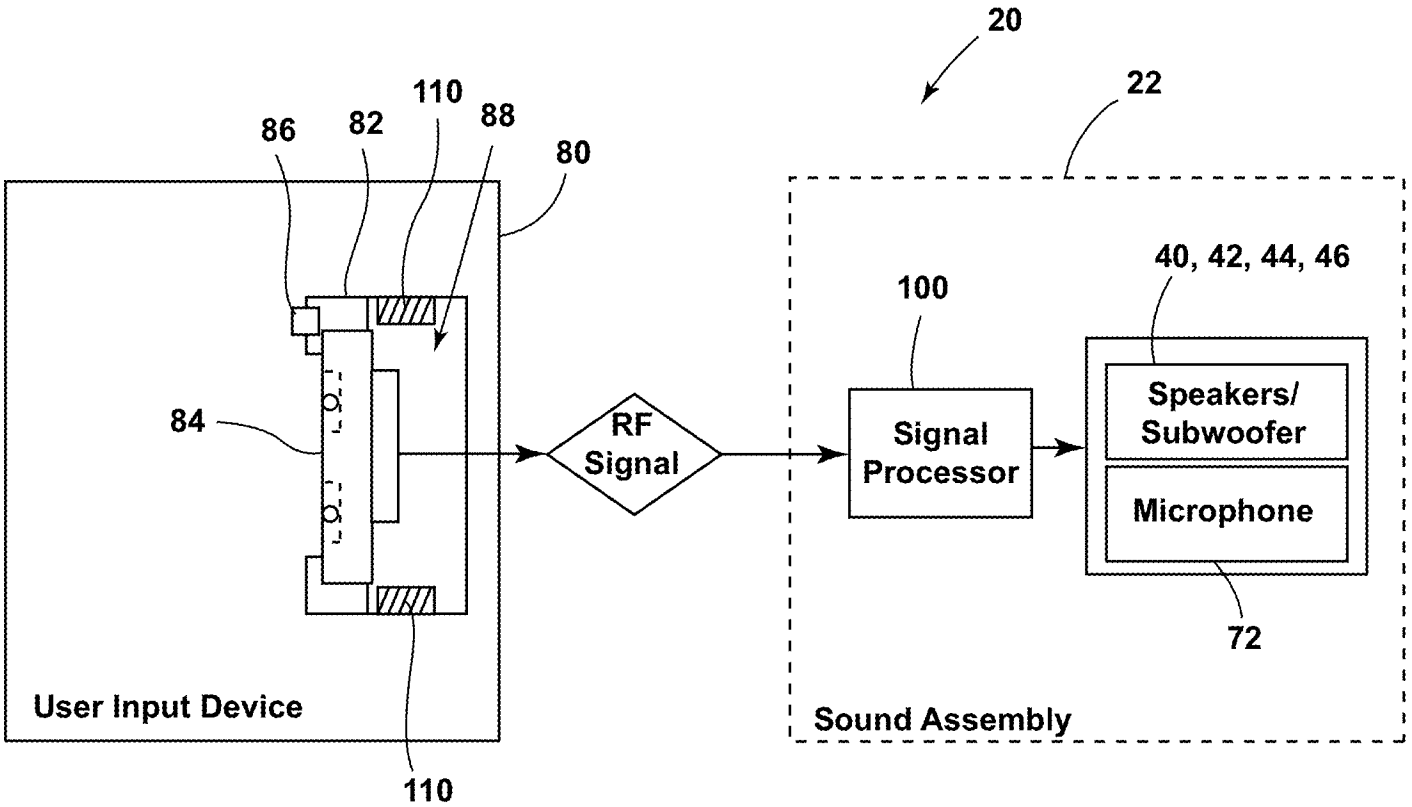
FIGS. 9-12 are schematic views generally illustrating embodiments of user input devices of sound systems according to teachings of the present disclosure.

In embodiments, such as generally illustrated in FIG. 7, a user input device 80 may include a static configuration in which portions 90, 92, 94 of a touch sensor 88 may be static/fixed. For example and without limitation, the left portion 90 of the touch sensor 88 may correspond to a left rear seat $\mathbf{32}_3$, the middle portion 92 of the touch sensor 88 may correspond to the middle rear seat $\mathbf{32}_4$, and/or the right portion 94 of the touch sensor 88 may correspond to the right rear seat $\mathbf{32}_5$, such as regardless of the position of the user input device 80. Additionally or alternatively, a user input device 80 may include a dynamic configuration in which portions of a touch sensor 88 may be adjustable (see, e.g., FIG. 8). For example and without limitation, for applications (e.g., vehicles 30) with multiple rows of seats 32 and/or reconfigurable seats 32, the positions of rear seats $\mathbf{32}_3$-$\mathbf{32}_8$ may change and the user input device 80 may be configured to allocate/reposition portions of the touch sensor 88 for each seat $\mathbf{32}_3$-$\mathbf{32}_8$ according to the current position of each seat $\mathbf{32}_3$-$\mathbf{32}_8$ and/or to the position of the user input device 80 (which may be adjusted by an occupant 66). The sound system 20 may be configured to obtain seat position information via the controller 26.

With embodiments, dynamically allocating portions of the touch sensor 88 may include determining coordinates (e.g., global X, Y, Z coordinates in a vehicle 30) for the user input device 80 (e.g., the rear-view mirror), some or all seats 32 (e.g., the headrests 64 and/or sound assemblies 22 thereof), and/or some or all occupants 66. For example and without limitation, at least four corners (e.g., the rear four corners) of the user input device 80 and/or at least four corners (e.g., the front four corners) of each headrest 64 of the seats 32 may be tracked with global coordinates. The user input device 80 may use the global coordinates to allocate portions of the touch sensor 88 to each headrest 64. For example, if three headrests 64 are on the right side of a vehicle 30, in the same or different rows, the user input device 80 may allocate the right half of the touch sensor 88 to those three headrests 64 and may allocate three corresponding portions of the right half of the touch sensor 88 to the three headrests 64. Additionally or alternatively, the user input device 80 may utilize the X-coordinates of the headrests 64 to determine which headrest 64/sound assembly 22 should be assigned a full portion in the event of an overlap with headrests 64 in other rows, and/or the user input device 80 may utilize the Z-coordinate(s) to avoid overlapping of portions of the touch sensor 88 in the Z-direction.

In embodiments, the user input device 80 may be configured to override or ignore (to a desired extent or degree) occupant 66 inputs to the user input device 80. For example and without limitation, the user input device 80 may include and/or be connected to one or more override sensors. The one or more override sensors may include an override touch sensor 110 that may be disposed at or about an outer edge or surface of the user input device 80 and may be configured to sense if an occupant 66 is touching the outer edge or surface of the user input device 80, which may indicate that the occupant 66 is attempting to reposition the user input device 80 and not to activate/engage with the sound system 20 (see, e.g., FIG. 9).

Figure 10:
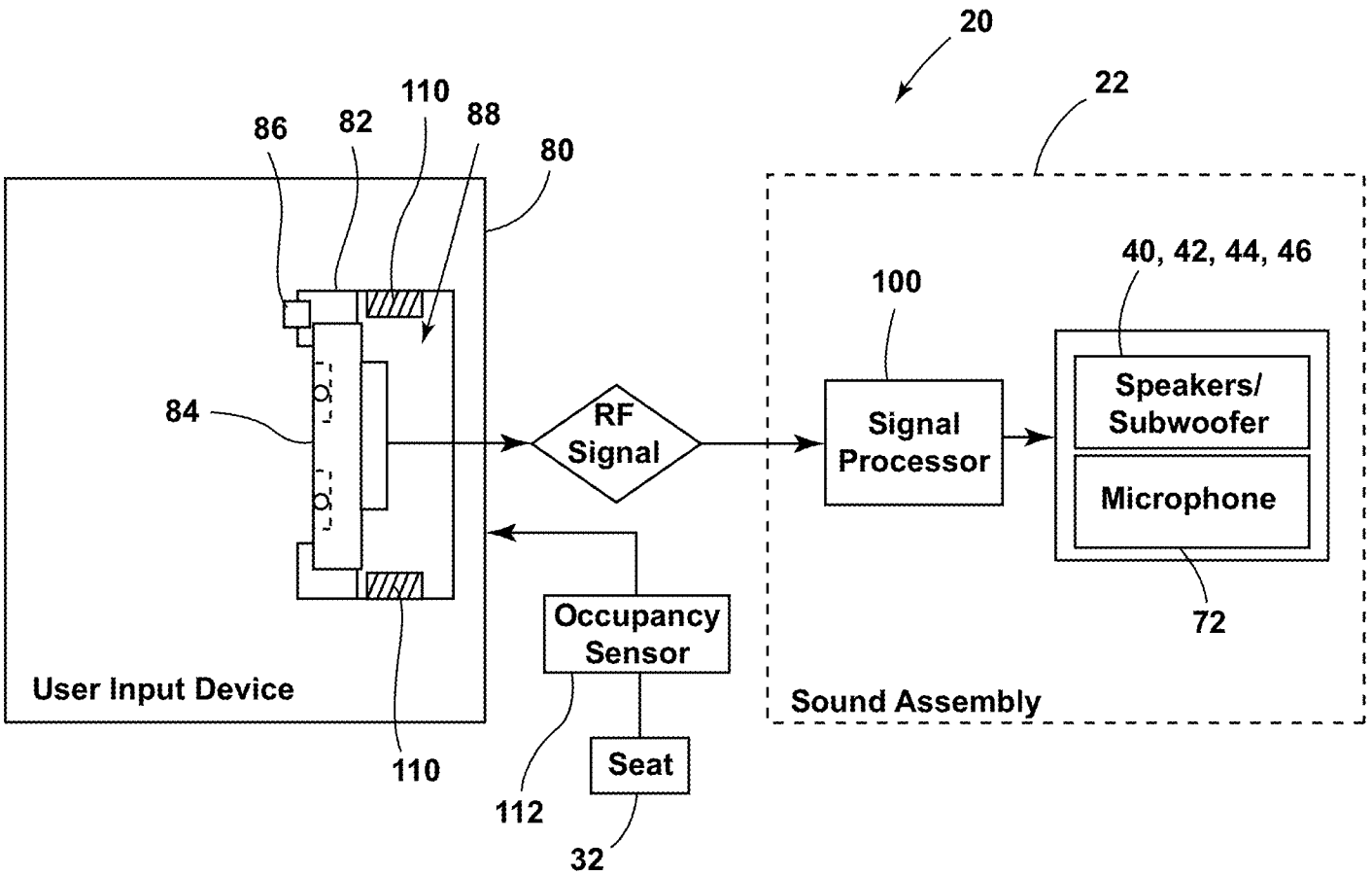

With embodiments, such as generally illustrated in FIG. 10, an override sensor may include an occupancy sensor 112 connected to a seat 32. If the user input device 80 determines that a seat 32 is not occupied, the user input device 80 may ignore touches from an occupant 66 in the portion of the touch sensor 88 corresponding to an unoccupied seat 32 and/or the user input device 80 may not allocate a portion of the touch sensor 88 to unoccupied seats 32.

Figure 11:
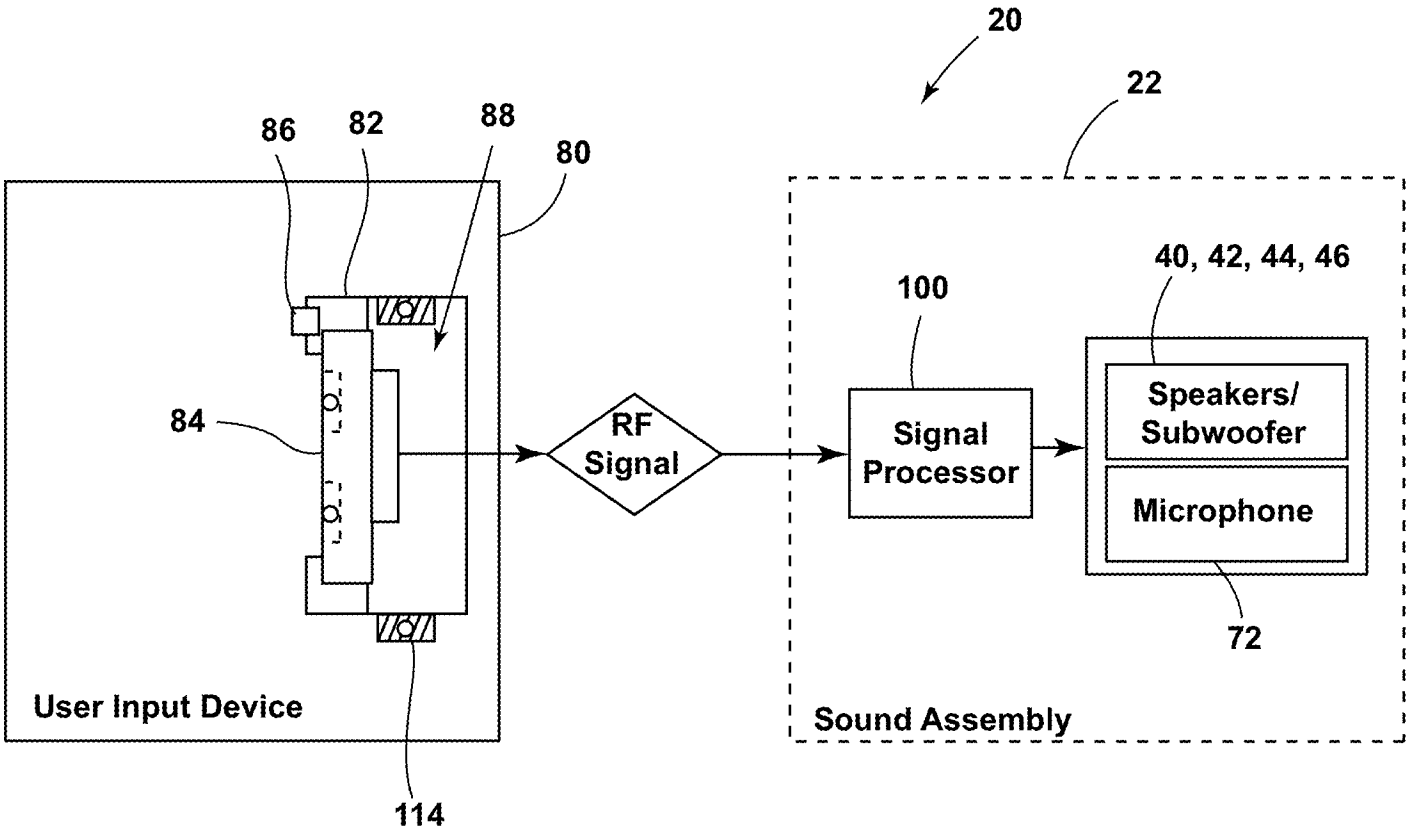

In embodiments, such as generally illustrated in FIG. 11, an override sensor may include one or more other controls 114 connected to the user input device 80 (e.g., buttons, such as for phone calls, emergency signals, dimming, etc.). If the user input device 80 determines that a control 114 is being activated, the user input device 80 may ignore touches from an occupant 66 while the control 114 is being activated.

Figure 12:
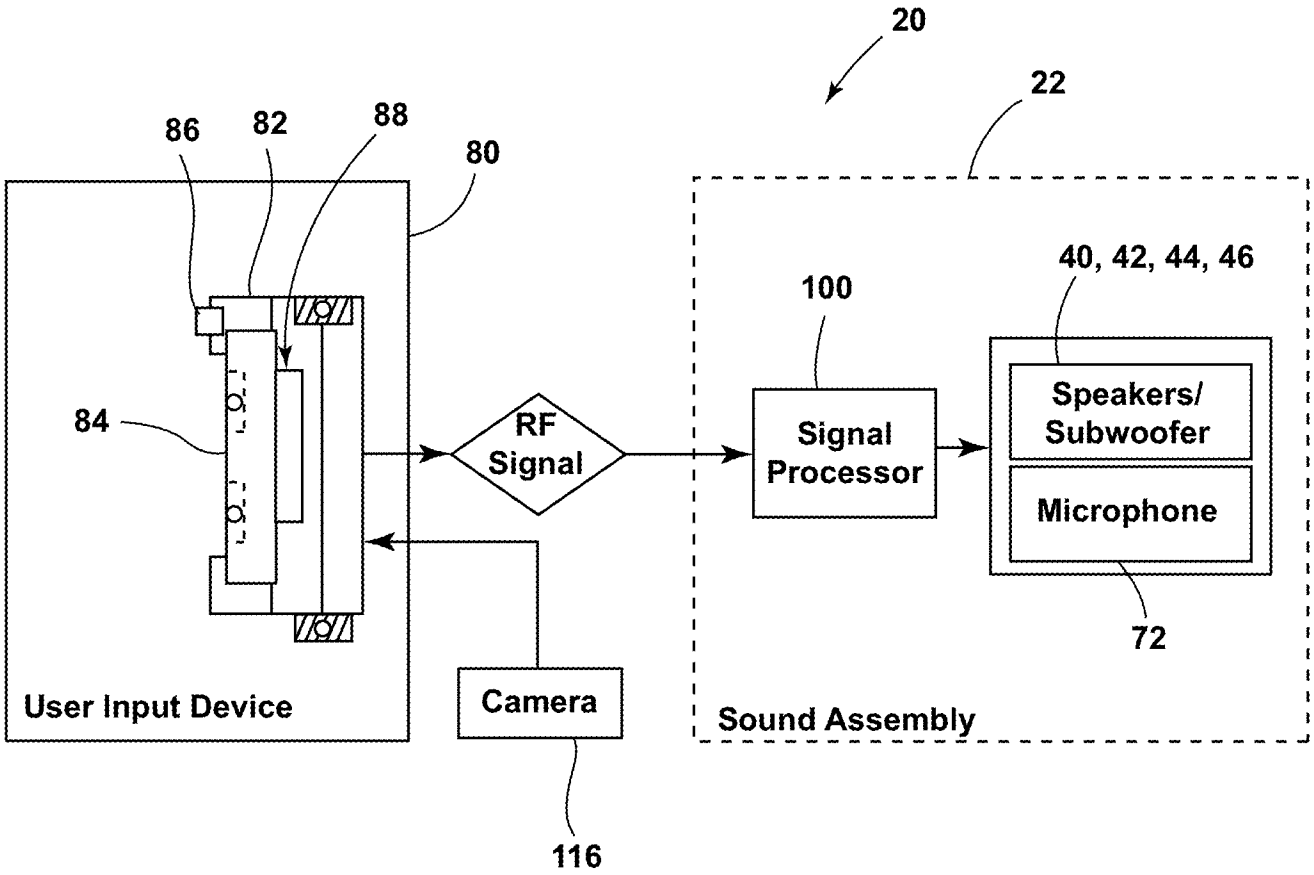

With embodiments, such as generally illustrated in FIG. 12, the user input device 80 may be configured to determine if images or video (e.g., from a back-up camera 116) are being displayed, such as at the mirrored surface 84. If images or video are being displayed, the user input device 80 may disable the touch sensor 88, may not allocate portions of the touch sensor 88 to the areas where the images or video are being displayed, and/or may allocate only portions of the touch sensor 88 at or about edges of the mirrored surface 84.

Figure 13:
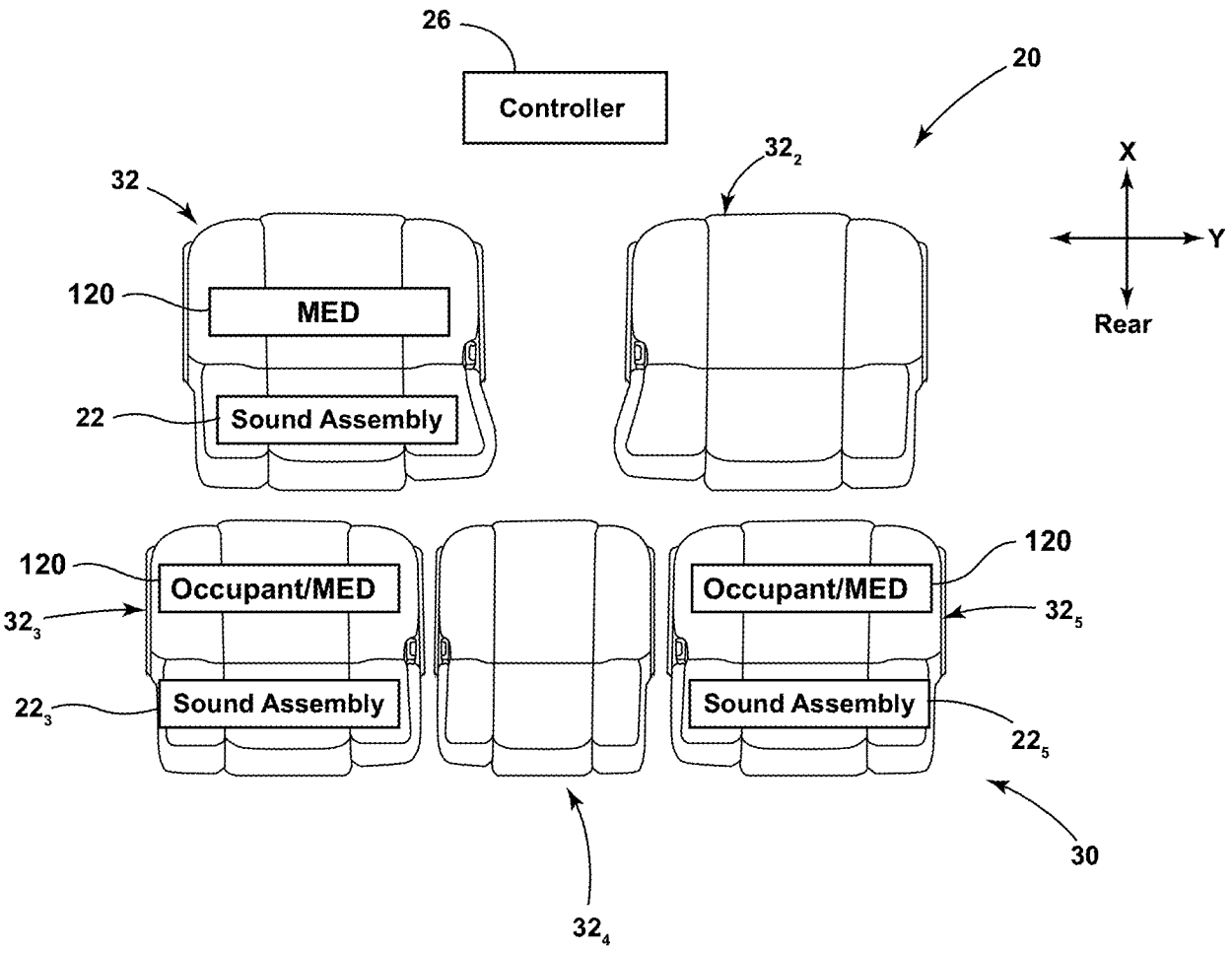
FIG. 13 is a top view generally illustrating an embodiment of a sound system according to teachings of the present disclosure.

In embodiments, a sound system 20 may be configured to provide language translation. As generally illustrated in FIG. 13, a sound system 20 may include a plurality of sound assemblies 22, which may each be associated with and/or connected to a respective vehicle location/seat 32. Occupants 66 of the vehicle locations/seats 32 may have a mobile electronic device or MED 120 (e.g., cellular phone, tablet, laptop, etc.). Occupants 66 may set a preferred language for sound systems 20 in the mobile electronic device 120. Upon entering a vehicle 30 with a sound system 20, the mobile electronic device 120 may connect with a controller 26 of the sound system 20 (e.g., via Bluetooth and/or other connection) and may provide an indication of the preferred language to the controller 26. The controller 26 may set the language associated with the corresponding sound assembly 22 to the preferred language. The controller 26 may be configured to translate audio in the vehicle 30 (e.g., speech from other occupants 66 in the vehicle 30) into the preferred language and provide the translated audio to the sound assembly 22 of the location/seat 32 of the occupant 66.

Figure 14:
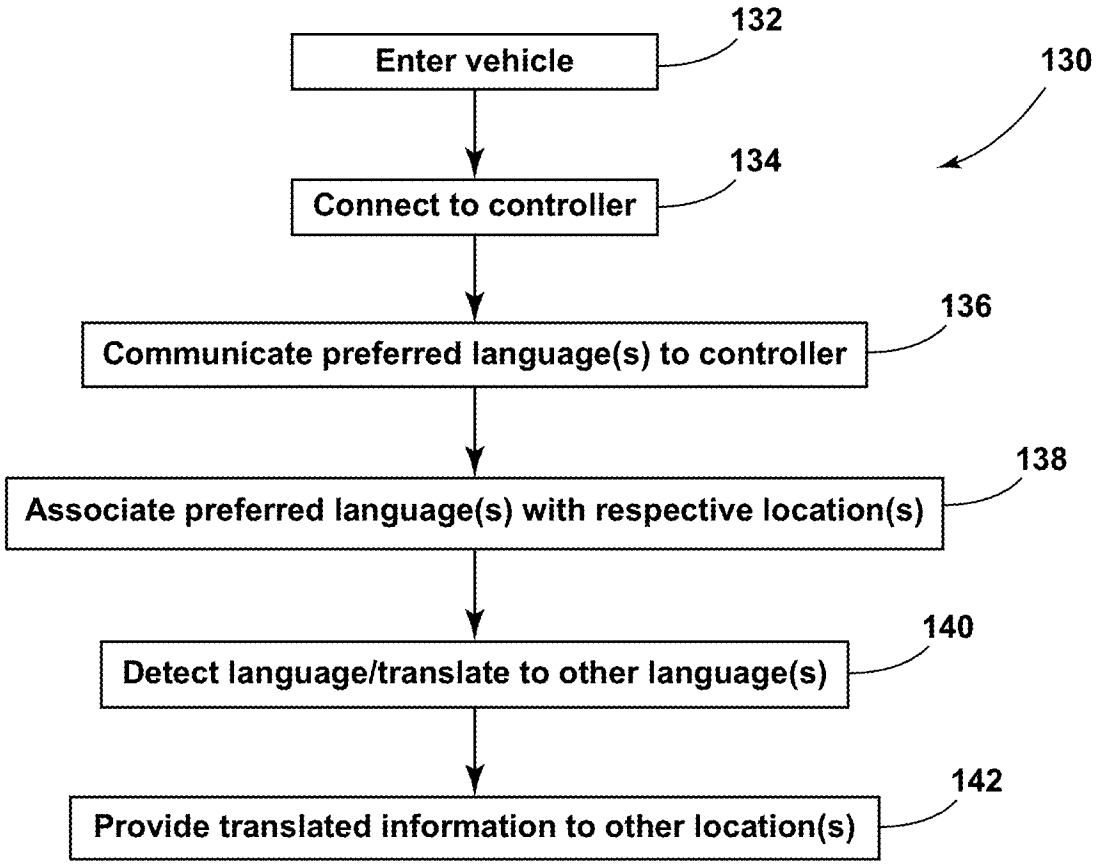
FIG. 14 is a flow diagram generally illustrating an embodiment of a method of operating a sound system according to teachings of the present disclosure.

With embodiments, a plurality of occupants 66 may be disposed in a vehicle 30. As generally illustrated in FIG. 14, a method 130 of operating a sound system 20 may include an occupant 66 entering a vehicle 30 and sitting in a seat 32 (step 132). A mobile electronic device 120 of the occupant 66 may connect with the controller 26 of the sound system 20 (step 134) and may communicate a respective preferred language to the controller 26 (step 136). The controller 26 may assign the respective selected or preferred language to the corresponding seat 32/sound assembly 22 (step 138). If one occupant 66 speaks, the controller 26 may be configured to detect the language of the speech and translate the speech into the preferred languages of the other occupants 66 (e.g., substantially simultaneously), if different from the detected language (step 140). The controller 26 may then provide translated audio to each seat 32/sound assembly 22 (step 142). For example and without limitation, if a first occupant 66 speaks in a first language, the controller 26 may be configured to translate the speech into the selected or preferred language of a second occupant 66 (e.g., a second language), provide corresponding audio in the second language to the sound assembly 22 of the seat 32 of the second occupant 66, translate the speech into the selected or preferred language of a third occupant 66 (e.g., a third language), and/or provide corresponding audio in the third language to the sound assembly 22 of the seat 32 of the third occupant 66. In embodiments, the controller 26 may conduct translations and/or translations may be conducted, at least in part, via the mobile electronic device 120 of the occupant 66.

In embodiments, a controller (e.g., the controller 26) may include an electronic controller and/or include an electronic processor, such as a programmable microprocessor and/or microcontroller. In embodiments, a controller may include, for example, an application specific integrated circuit (ASIC). A controller may include a central processing unit (CPU), a memory (e.g., a non-transitory computer-readable storage medium), and/or an input/output (I/O) interface. A controller may be configured to perform various functions, including those described in greater detail herein, with appropriate programming instructions and/or code embodied in software, hardware, and/or other medium. In embodiments, a controller may include a plurality of controllers. In embodiments, a controller may be connected to a display, such as a touchscreen display.

Various examples/embodiments are described herein for various apparatuses, systems, and/or methods. Numerous specific details are set forth to provide a thorough understanding of the overall structure, function, manufacture, and use of the examples/embodiments as described in the specification and illustrated in the accompanying drawings. It will be understood by those skilled in the art, however, that the examples/embodiments may be practiced without such specific details. In other instances, well-known operations, components, and elements have not been described in detail so as not to obscure the examples/embodiments described in the specification. Those of ordinary skill in the art will understand that the examples/embodiments described and illustrated herein are non-limiting examples, and thus it can be appreciated that the specific structural and functional details disclosed herein may be representative and do not necessarily limit the scope of the embodiments.

Reference throughout the specification to "examples, "in examples," "with examples," "various embodiments," "with embodiments," "in embodiments," or "an embodiment," or the like, means that a particular feature, structure, or characteristic described in connection with the example/embodiment is included in at least one embodiment. Thus, appearances of the phrases "examples, "in examples," "with examples," "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more examples/embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of examples/embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

All matter contained in the above description or shown in the accompanying drawings shall be interpreted as illustrative only and not limiting. Changes in detail or structure may be made without departing from the present disclosure.

It should be understood that a controller (e.g., the controller 26), a system, and/or a processor as described herein may include a conventional processing apparatus known in the art, which may be capable of executing preprogrammed instructions stored in an associated memory, all performing in accordance with the functionality described herein. To the extent that the methods described herein are embodied in software, the resulting software can be stored in an associated memory and can also constitute means for performing such methods. Such a system or processor may further be of the type having ROM, RAM, RAM and ROM, and/or a combination of non-volatile and volatile memory so that any software may be stored and yet allow storage and processing of dynamically produced data and/or signals.

It should be further understood that an article of manufacture in accordance with this disclosure may include a non-transitory computer-readable storage medium having a computer program encoded thereon for implementing logic and other functionality described herein. The computer program may include code to perform one or more of the methods disclosed herein. Such embodiments may be configured to execute via one or more processors, such as multiple processors that are integrated into a single system or are distributed over and connected together through a communications network, and the communications network may be wired and/or wireless. Code for implementing one or more of the features described in connection with one or more embodiments may, when executed by a processor, cause a plurality of transistors to change from a first state to a second state. A specific pattern of change (e.g., which transistors change state and which transistors do not), may be dictated, at least partially, by the logic and/or code.

What is claimed is:

1. A sound system, comprising:
a seat, including:
a seatback having:
a first dipole subwoofer;
a second dipole subwoofer;
a first speaker; and
a second speaker; and
a seat bottom having a third speaker;
wherein the first dipole subwoofer, the second dipole subwoofer, the first speaker, the second speaker, and the third speaker are configured to receive audio signals from a receiver and provide sound corresponding to the audio signals toward an occupant position of the seat.

2. The sound system of claim 1, wherein the third speaker is directed toward the seat back.

3. The sound system of claim 1, wherein the first dipole subwoofer, the second dipole subwoofer, the first speaker, the second speaker, and the third speaker are configured to provide a sound zone for an occupant in the occupant position that facilitates (i) hearing of the sound by said occupant, and (ii) limiting transmission of the sound beyond the seat.

4. The sound system of claim 1, wherein the first speaker and the second speaker are configured to provide noise-canceling sound.

5. The sound system of claim 1, wherein the seatback includes a headrest; and at least two of the first dipole subwoofer, the second dipole subwoofer, the first speaker, and the second speaker are connected to the headrest.

6. The sound system of claim 1, wherein the seatback includes a headrest; the first dipole subwoofer and the first speaker are disposed at a first side of the headrest; and the second dipole subwoofer and the second speaker are disposed at a second side of the headrest.

7. The sound system of claim 1, wherein the first speaker and the second speaker have an end-fire array configuration.

8. The sound system of claim 1, wherein the first speaker and the second speaker have a single dipole configuration.

9. The sound system of claim 1, wherein the seatback includes a headrest; and the first speaker and the second speaker are disposed at least partially in the headrest.

10. The sound system of claim 9, wherein the first dipole subwoofer and the second dipole subwoofer are disposed at least partially in the headrest.

11. The sound system of claim 1, including:
a user input device configured to receive a touch input from a first occupant for activating a private intercom with a second occupant; and
an electronic controller configured to facilitate substantially simultaneous translation of audio in a first language from the first occupant to a second language for the second occupant and a third language for a third occupant.

12. The sound system of claim 1, including:
a user input device configured to receive a touch input from a first occupant for selectively muting a second occupant.

13. A method of operating a sound system, the method comprising:
providing, from a receiver, a first audio signal to a plurality of seats;
providing sound corresponding to the first audio signal to respective occupants of the plurality of seats;
providing, from the receiver, a second audio signal to a first seat of the plurality of seats; and
providing sound corresponding to the second audio signal to the occupant of the first seat such that the sound corresponding to the second audio signal is substantially inaudible to other occupants;
wherein providing sound corresponding to the second audio signal includes providing sound via a first dipole subwoofer, a second dipole subwoofer, a first speaker, a second speaker, and a third speaker.

14. The method of claim 13, wherein the first seat includes a seatback and a seat bottom; the seatback includes the first dipole subwoofer, the second dipole subwoofer, the first speaker, and the second speaker; and the seat bottom includes the third speaker.

15. The method of claim 13, wherein the first speaker and the second speaker have a single dipole configuration or an end-fire array configuration.

16. The method of claim 15, wherein each respective sound assembly includes a plurality of speakers and a plurality of subwoofers.

17. The method of claim 15, wherein providing sound corresponding to the second audio signal includes providing sound corresponding to the second audio signal via the respective sound assembly associated with the first seat and not providing sound corresponding to the second audio signal via the respective sound assemblies associated with other seats of the plurality of seats.

18. The method of claim 13, wherein providing sound corresponding to the first audio signal includes providing sound corresponding to the first audio signal via a respective sound assembly associated with each seat of the plurality of seats.

19. The method of claim 13, including:

receiving, via a user input device, a touch input from the occupant of the first seat to activate a private intercom with a second occupant; and translating sound in a first language from the occupant of the first seat to a second language for the second occupant.

* * * * *